US011151934B2

(12) United States Patent
Xu et al.

(10) Patent No.: US 11,151,934 B2
(45) Date of Patent: Oct. 19, 2021

(54) AMOLED DISPLAY STICKING IMAGE ELIMINATION METHOD, DISPLAY TERMINAL AND STORAGE MEDIUM

(71) Applicant: SHENZHEN SKYWORTH-RGB ELECTRONIC CO., LTD., Shenzhen (CN)

(72) Inventors: Yaoling Xu, Shenzhen (CN); Jian Li, Shenzhen (CN); Junsheng Wang, Shenzhen (CN)

(73) Assignee: SHENZHEN SKYWORTH-RGB ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 17/000,324

(22) Filed: Aug. 23, 2020

(65) Prior Publication Data

US 2020/0394956 A1 Dec. 17, 2020

Related U.S. Application Data

(63) Continuation of application No. PCT/CN2018/120037, filed on Dec. 10, 2018.

(30) Foreign Application Priority Data

Oct. 25, 2018 (CN) ..... 201811254571.2

(51) Int. Cl.
*G09G 3/3225* (2016.01)
*G09G 3/00* (2006.01)
*G09G 3/20* (2006.01)

(52) U.S. Cl.
CPC ..... *G09G 3/3225* (2013.01); *G09G 3/006* (2013.01); *G09G 3/2007* (2013.01);
(Continued)

(58) Field of Classification Search
CPC ... G09G 2320/0233; G09G 2320/0252; G09G 2320/0257; G09G 2320/0285;
(Continued)

(56) References Cited

U.S. PATENT DOCUMENTS

2007/0229405 A1 10/2007 Moon
2015/0287350 A1 10/2015 Jun et al.
(Continued)

FOREIGN PATENT DOCUMENTS

CN 1435811 A 8/2003
CN 103198790 A 7/2013
(Continued)

OTHER PUBLICATIONS

First Office Action in counterpart Chinese Application No. 201811254571.2, dated Dec. 3, 2019.
(Continued)

*Primary Examiner* — Kenneth Bukowski
(74) *Attorney, Agent, or Firm* — Westbridge IP LLC

(57) ABSTRACT

The present disclosure discloses an AMOLED display sticking images elimination method. When an AMOLED display panel is detected to be connected to electricity, the first duration of electricity connection of the display panel is calculated. Based on the first duration of electricity connection, gray scale compensation values of the corresponding TFTs are obtained; based on the gray scale compensation values, the TFTs are compensated according to the gray scale compensation values, so that the driving electricity of the TFTs corresponding to the display panel is amended, and the driving electricity flowing through the TFT is kept consistent. The disclosure further discloses a display terminal and a computer readable storage medium. According to
(Continued)

the present disclosure, the problem of the AMOLED display sticking images is solved by using the low-cost and simple implementation mode.

17 Claims, 4 Drawing Sheets

(52) U.S. Cl.
CPC ..... *G09G 2320/0233* (2013.01); *G09G 2320/0252* (2013.01); *G09G 2320/0257* (2013.01); *G09G 2320/041* (2013.01)

(58) Field of Classification Search
CPC ..... G09G 2320/0295; G09G 2320/041; G09G 2320/043; G09G 3/006; G09G 3/2007; G09G 3/3225; G09G 3/3233; G09G 3/3241; G09G 3/3258; G09G 3/3291; G09G 2300/0809; G09G 2300/0819; G09G 2300/0842
See application file for complete search history.

(56) References Cited

U.S. PATENT DOCUMENTS

| | | | | |
|---|---|---|---|---|
| 2017/0169767 | A1* | 6/2017 | Song | G09G 3/3291 |
| 2018/0130394 | A1 | 5/2018 | Hwang | |

FOREIGN PATENT DOCUMENTS

| | | | |
|---|---|---|---|
| CN | 104021755 | A | 9/2014 |
| CN | 104021759 | A | 9/2014 |
| CN | 105096824 | A | 11/2015 |
| CN | 105869568 | A | 8/2016 |
| CN | 107274834 | A | 10/2017 |

OTHER PUBLICATIONS

International Search Report and Written Opinion in corresponding PCT Application No. PCT/CN2018/120037, dated Jul. 24, 2019.
Second Office Action in counterpart Chinese Application No. 201811254571.2, dated Jul. 15, 2020.

* cited by examiner

AMOLED DISPLAY STICKING IMAGE ELIMINATION METHOD, DISPLAY TERMINAL AND STORAGE MEDIUM

CROSS-REFERENCE TO RELATED APPLICATIONS

The present application is a continuation application of PCT application No. PCT/CN2018/120037, filed on Dec. 10, 2018, which claims the benefits of Chinese patent application No. 201811254571.2, filed on Oct. 25, 2018, entitled "AMOLED DISPLAY STICKING IMAGE ELIMINATION METHOD, DISPLAY TERMINAL AND STORAGE MEDIUM". The entire disclosures of which are hereby incorporated by reference, in their entireties, for all that they teach and for all purposes.

FIELD

The present disclosure relates to the field of plane display technology, in particular to an AMOLED display sticking image elimination method, a display terminal and a storage medium.

BACKGROUND

OLED stands for Organic Light-Emitting Diode, including AMOLED (Active-matrix Organic Light-Emitting Diode), and PMOLED (Passive-Matrix Organic Light-Emitting Diode). OLED display technology has a property of self luminosity, configured with a very thin organic material coating and glass substrate. When connected with electricity, those organics materials are luminous. Moreover, an AMOLED has benefits of: quick response speed, higher contract, wider visual angle, and electricity saving. So far, the AMOLED is more and more adopted for displays of televisions, mobile phones, digital cameras, and etc.

The AMOLED is an electricity-driven component. At an AMOLED pixel on an AMOLED display, there is a thin film transistor integrated as a driving circuit of the AMOLED pixel. However, during the process of operating the AMOLED display panel, due to heat emitting, causing a threshold voltage drift problem (simplified as: temperature drift), by which causing Mura phenomenons or sticking images. The Mura phenomenons refer to sticking image phenomenon of sorts that are caused by the non-uniformity of the luminosity of a display panel.

In order to solve the AMOLED sticking image problem, most of the present solutions are to amend a TFT temperature drift based on configuring a sub-circuit on the TFT of the AMOLED pixel, such as: 4T2C, 6T1C, etc. When the temperature drift of the TFT is relatively low, the solutions above are efficient, while when the temperature drift is relatively high, the solutions lose their efficiency. Meanwhile, the difficulty and cost of configuring the sub-circuit are relatively high. The configured sub-circuit also slows down the responding speed of the AMOLED display, effecting the aperture opening ratio of the AMOLED panel, and reducing an emitting ratio, etc.

The contents above are merely for interpretation assistance of the present disclosures, without acknowledging that the contents above are prior arts.

SUMMARY

The present application is mainly to provide an AMOLED displaying sticking image elimination method, aiming to solve the technical problem of sticking images produced by an AMOLED display panel.

In order to realize the purpose above, the present disclosure provides an AMOLED display sticking image elimination method, the AMOLED display sticking image elimination method includes the following steps:

calculating a first duration of electricity connection of the display panel when detecting an AMOLED display panel is connected to electricity;

obtaining each gray scale compensation value of each corresponding TFT based on the first duration of electricity connection;

amending a driving electricity of each corresponding TFT on the display panel based on the each gray scale compensation value.

Besides, to realize the purpose above, the present disclosure also provides a display terminal, the display terminal includes: an AMOLED display panel, a storage, a processor, and an AMOLED display sticking image elimination program stored in the storage and is configured to be performed on the processor, the steps below are realized when the AMOLED display sticking image elimination program is performed by the processor:

when detecting the AMOLED display panel is connected to electricity, calculating a first duration of electricity connection of the display panel;

obtaining each gray scale compensation values of each corresponding TFT based on the first duration of electricity connection;

amending driving electricity of each corresponding TFT of the display panel based on the each gray scale compensation values.

Besides, to realize the purpose above, the present also provides a computer readable storage medium, an AMOLED display sticking image elimination program is stored in the computer readable storage medium, when the AMOLED display sticking image elimination program is performed by a processor, realizing the following steps:

calculating a first duration of electricity connection of the display panel when detecting the AMOLED display panel is connected to electricity;

obtaining each gray scale compensation values of each corresponding TFT based on the first duration of electricity connection;

amending driving electricity of each corresponding TFT of the display panel based on the each gray scale compensation values.

The AMOLED display sticking image elimination method, display terminal and storage medium of the present disclosure, by calculating the first duration of electricity connection of the display panel when detecting the AMOLED display panel is connected to electricity, obtaining each gray scale compensation values of each corresponding TFT based on the first duration of electricity connection, and amending driving electricity of each corresponding TFT of the display panel based on the each gray scale compensation value, it causes the driving electricity going through each TFT to be consistent, solves the problem that the AMOLED will produces display sticking images due to temperature drifts. Moreover, by adopting a gray scale compensation values compensating method to take the place of building sub-circuits, it solves the problems that it is difficult to build sub-circuits, the cost of building sub-circuits is high, the responding speed of the AMOLED display will be slowed down, which effecting the aperture ratio of the AMOLED panel, and reducing its emitting efficiency.

The realization of the purpose, characteristics and adventures of configurations of the present disclosure will be further described according to the figures, referring to embodiments.

DETAILED DESCRIPTION OF THE EMBODIMENTS

It should be understood that, detail embodiments described herein are merely for describing the present disclosure, but not for limiting the present disclosure.

A major solution in embodiments of the present disclosure is: upon detecting that an AMOLED display panel is connected to electricity, calculating a first duration of electricity connection of the display panel. According to the first duration of electricity connection, obtaining a corresponding gray scale compensation value of each TFT. According to the gray scale compensation value, adjusting a corresponding driving electricity of each TFT on the display panel.

In the currently existing technologies, most solutions are amending a temperature drift of the TFT based on configuring a sub-circuit on the TFT of the AMOLED, such as: 4T2C, 6T1C, etc. When the temperature drift of the TFT is relatively low, the operation above is efficient, while when the temperature drift is relatively high, the operation loses its efficiency. Meanwhile, the difficulty and cost of configuring sub-circuits are relatively high. The sub-circuits also slows down the responding speed of the AMOLED display, effecting the aperture opening ratio of the AMOLED panel, causing the reduction of an emitting ratio, etc.

The present disclosure discloses a solution to solve the problem of which the AMOLED has display sticking images due to a temperature drift. Furthermore, adapting a gray scale compensation value method instead of configuring sub-circuits, solving the problems that it's difficult to build sub-circuits; the cost is high; the responding speed of the AMOLED display is reduced; the aperture opening ratio of the AMOLED panel is effected; and the emitting efficiency is weakened.

Figure 1:
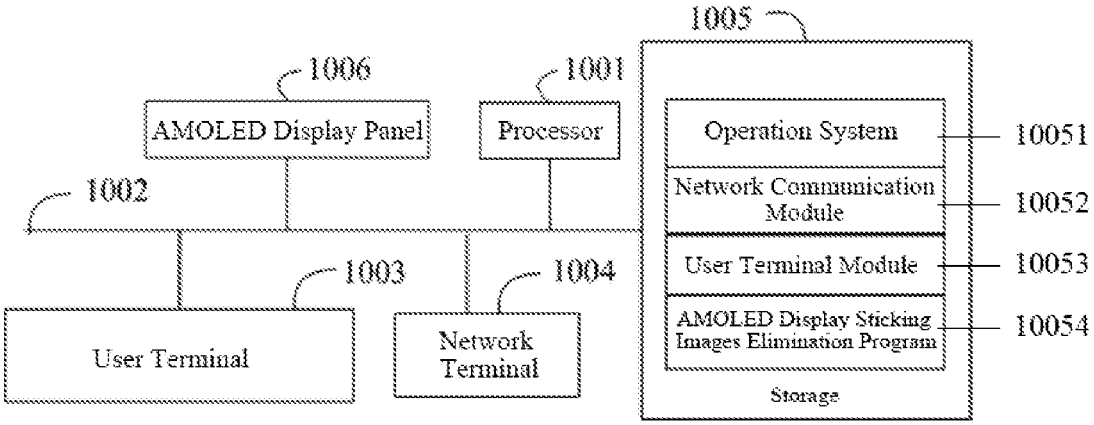
FIG. 1 is a schematic diagram of a display terminal structure of a hardware operation environment of the present disclosure.

FIG. 1 is a schematic diagram of a display terminal involving a hardware operation environment of the embodiments of the present disclosure.

A display terminal of the embodiments could be a display terminal device with obvious display function like a television, as well as a PC, smart phone, tablet personal computer, digital books reader, MP3 (Moving Picture Experts Group Audio Layer III) player, MP4 (Moving Picture Experts Group Audio Layer IV) player, portable computer so on and so forth.

According to FIG. 1, the display terminal can include: a processor 1001, such as a CPU, a network terminal 1004, a user terminal 1003, a storage 1005, a communication bus 1002, and an AMOLED display panel 1006. The communication bus 1002 is used for the realization of the connection and communication of these components. The user terminal 1003 can include an input unit for instance a keyboard. The user terminal 1003 can optionally include a standard wired terminal, a wireless terminal. The network terminal 1004 optionally can include a standard wired interface, and a wireless terminal (such as WI-FI). The storage 1005 can be a fast speed RAM storage, or a stable storage (non-volatile memory), such as a disk storage. The storage 1005 optionally can also be a storage equipment independent to the processor 1001 above.

Those skilled in the art should understand that the structure of the display terminal shown in the FIG. 1 does not create any limitation on the display terminal, which can include components more or less than that shown in FIG. 1, or combine some certain components, or with different component arrangements.

According to FIG. 1, as a computer storage medium, the storage 1005 can also include an operation system 10051, a network communication module 10052, a user terminal module 10053 and an AMOLED display sticking image elimination program 10054.

In the display terminal 100 shown in the FIG. 1, the user terminal 1004 is mainly configured to connect a back-end server, executing a data communication with the back-end server. The user terminal 1003 is mainly configured to connect to a client terminal (user end), executing a data communication with the client terminal. The processor 1001 is configured to call the AMOLED display sticking image elimination program 10054 of the storage 1005, and implement the following operations:

upon detecting that an AMOLED display panel is connected to electricity, calculating a first duration of electricity connection of the display panel;

according to the first duration of electricity connection, obtaining a corresponding gray scale compensation value of each TFT;

according to the gray scale compensation value, adjusting a driving electricity of each TFT of the display panel.

According to the hardware structure above, embodiments of the present disclosure are provided.

Figure 2:
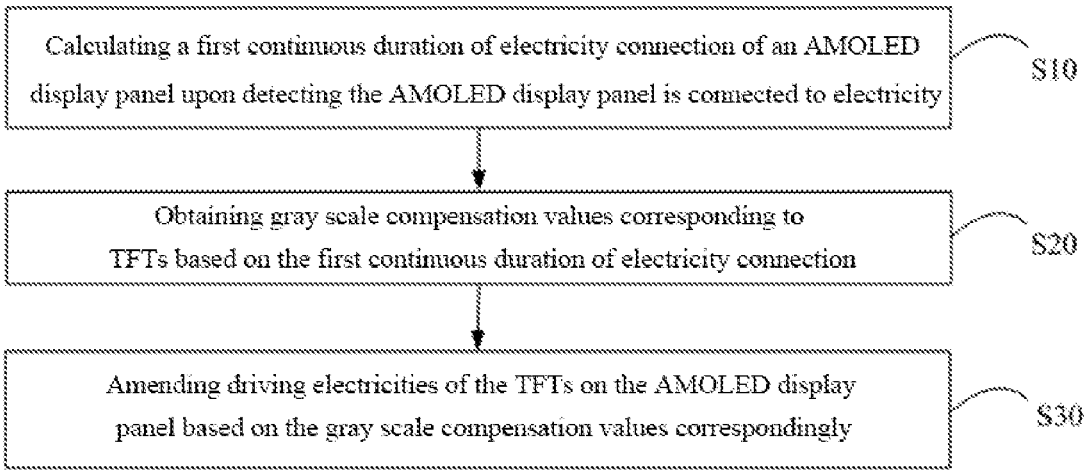
FIG. 2 is a schematic flowchart of a first embodiment of an AMOLED display sticking image elimination method of the present disclosure.

In FIG. 2, in a first embodiment of the present disclosure, the AMOLED display sticking image elimination method includes:

Step S10, upon detecting that an AMOLED display panel is connected to electricity, calculating a first duration of electricity connection of the display panel;

When detecting that an AMOLED display panel is connected to electricity, from the exact moment, calculating a first duration of electricity connection of the display panel, in particular, the display panel is connected to electricity herein is referring that users connect the normally used AMOLED display panel to electricity and the AMOLED display panel has gained the configuration of eliminating display sticking images; the first duration of electricity connection is referring that calculating form the moment when the AMOLED display panel is connected to electricity, all the moments that the AMOLED display panel is continuously connected to electricity, and the total duration of the continuously-connected-to-electricity status. For instance, at 7:00 in the morning, detecting the AMOLED display panel is connected to electricity, and the AMOLED display panel is kept in the connected-to-electricity status until 7:50, thus between 7:00 and 7:50, executing time calculation for the duration of electricity connection of the display panel, each moment within the time between 7:00 and 7:50 has a corresponding duration of electricity connection.

Step S20, based on the first duration of electricity connection, obtaining a corresponding gray scale compensation value of each TFT;

in each different moment, based on a real-time duration of the corresponding first duration of electricity connection that is in a preset duration, obtaining a corresponding gray scale compensation value of each TFT of the real-time duration. In particular, there are multiple pixels on the AMOLED display panel, on which there is a TFT. The on-off of the driving electricity of the TFT can be controlled through a controlling signal of the TFT, thereby controlling the emitting of the pixel. The corresponding gray scale compensation value of each TFT is referring that each TFT has a corresponding gray scale compensation value, furthermore, gray scale compensation values of a corresponding TFT of different durations of electricity connection are different from each other. Confirming a gray scale compensation value of the corresponding TFT should be basing on the corresponding duration of electricity connection. For example, when the first duration of electricity connection is not less than 5 minutes and not more than 10 minutes, a corresponding gray scale compensation value is 3. When the first duration of electricity connection is not less than 11 minutes and not more than 15 minutes, a corresponding gray scale compensation value is 4. When the first duration of electricity connection is not less than 15 minutes and not more than 20 minutes, a corresponding gray scale compensation value is 5.

Step S30, based on the gray scale compensation values, amending driving electricity values of the corresponding TFTs on the display panel.

After obtaining the gray scale compensation value of the TFT corresponding to the first duration of electricity connection, under the present first duration of electricity connection, gray scale compensation values of the TFTs are different from each other under different display gray scales, thus it needs to obtain display data of each TFT and confirm a present display gray scale based on the required display data of each TFT, thereby further confirming, under the present first duration of electricity connection, the gray scale compensation value of each TFT of the present corresponding display gray scale. Then based on the confirmed gray scale compensation value of each TFT, it compensates the display data of each corresponding TFT, and transforms the obtained compensated display data into compensated driving data, in order to amend the driving electricity of each corresponding TFT on the display panel. For example, the display panel has high, medium, low three types of luminance, when the first duration of electricity connection is 15 minutes, the corresponding gray scale compensation value of each TFT under the respective high, medium, low three different types of luminance is respectively 3, 4, and 5, therefore after determining that the first duration of electricity connection is 15 minutes, it needs to confirm which luminance of the high, medium, low three types of luminance is referring to for each TFT, thereby determining which within the 3, 4, 5 three gray scale compensation values is corresponding to each TFT.

In particular, the driving electricity of each TFT is referring that: there are multiple pixels on the AMOLED display panel, there is one TFT on each pixel, there is one corresponding driving data on the TFTs, the driving data of the TFTs drive the corresponding TFT to generate driving electricities. For instance, there are pixels distributed on cross points in an i rows and j columns square on an AMOLED display panel, therefore, there are i times j amounts of TFTs, i times j amounts of driving data corresponding to the TFTs, and i times j amounts of driving electricity generated by the driving data.

In this embodiment, when a user is normally using an AMOLED display panel, it calculates different durations of electricity connection to confirm different gray scale compensation values. A TFT has temperature drifts of different extends under different durations of electricity connection. It obtains different gray scale compensation values under different durations of electricity connection to compensate display data of corresponding TFTs under temperature drifts of different extends, which avoids the problems of adopting a single compensation value, only eliminating sticking images within a short duration of connecting the electricity, makes the driving electricity of each TFT consistent during a very long duration of electricity connection, and solves the problem that the AMOLED has temperature drift due to emitting heat in the duration of electricity connection, which drives each TFT with changed driving electricity, and creates display sticking images.

Figure 3:
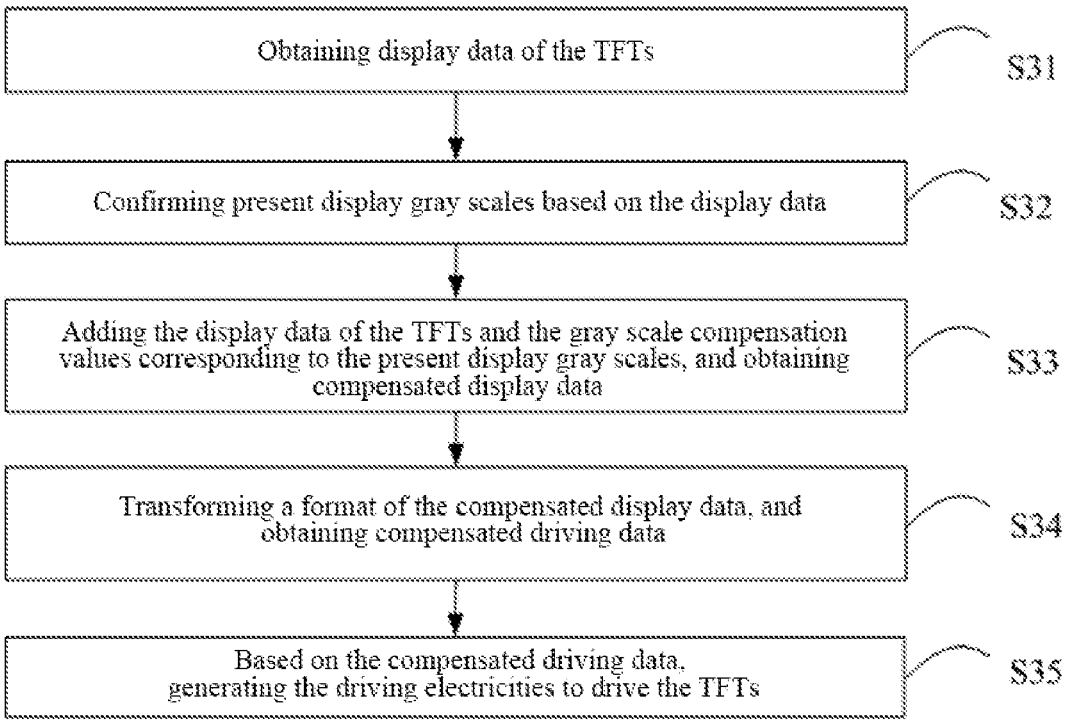
FIG. 3 is a detailed schematic flowchart of Step S30 of FIG. 2.

According to FIG. 3, in a second embodiment of the AMOLED display sticking image elimination method of the present disclosure, based on the embodiment of FIG. 2, Step S20 includes:

Step S21, dynamically obtaining a duration of the first duration of electricity connection in a preset time table.

In order to better interpret, here provides an example to describe: there are three periods in the duration of not more than 15 minutes of the preset time table, the first duration of electricity connection falling within the period of not more than 5minutes is taken as a real-time duration, within the period of not less than 6 minute and not more than 10 minutes is also taken as a real-time duration, within the period of not less than 11 minute and not more than 15 minutes is also taken as a real-time duration. The dynamically obtaining is referring that obtaining each period of the first duration of electricity connection within the period of not more than 15 minutes. When the obtained first duration of electricity connection is 1 minute, the first duration of electricity connection falls in the real-duration of not more than 5 minutes in the preset duration table. When the obtained first duration of electricity connection is 9 minutes, the first duration of electricity connection falls in the real-duration of not less than 6 minute and not more than 10 minutes in the preset duration table.

Step S22, based on the real-time duration, dynamically obtaining each gray scale compensation value of each corresponding TFT within a preset collection of gray scale compensation values.

Based on the dynamically obtained real-time duration that the first duration of electricity connection falls in, finding out the gray scale compensation values of the TFTs corresponding to the real-time duration within the collection of the preset gray scale compensation values. When there is no real-time duration corresponding to the first duration of electricity connection found, it adopts the real-time duration corresponding to a duration closest to the first duration of electricity connection, and extracts the gray scale compendation value of each TFT. In particular, the preset collection of the gray scale compensation values are referring that when the first durations of electricity connection of the TFTs is under a same real-time duration, different display gray scales correspond to different gray scale compensation values, and when the TFTs under a same display gray scale, the first duration of electricity connections of the TFTs falling in different real-time durations correspond to different gray scale compensation values. All of the gray scale compensation vales corresponding to the TFTs of different duration of electricity connection and different display gray scales constitute the preset collection of the gray scale compensation values.

For better interpretation, here uses the example in SS21 to describe, there are high, medium, low three different display gray scales corresponding to the first duration of electricity connection falling in the real-time duration of not more than 5 minutes, the gray scale compensation values corresponding to the high, medium, low three different display gray scales of each TFT is 2, 3, and 4 respectively. There are high, medium, low three different display gray scales corresponding to the first duration of electricity connection falling in the real-time duration of not less than 6 minutes and not more than 10 minutes, the gray scale compensation values corresponding to the high, medium, low three different display gray scales of each TFT is 5, 6, and 7 respectively. There are high, medium, low three different display gray scales corresponding to the first duration of electricity connection falling in the real-time duration of not less than 11 minutes and not more than 15 minutes, the gray scale compensation values corresponding to the high, medium, low which total up to three different display gray scales of each TFT is 8, 9, 10 respectively. Therefore, the preset collection of the gray scale compensation values includes 2, 3, 4, 5, 6, 7, 8, 9, and 10 which total up to nine gray scale compensation values. If confirming that the first duration of electricity connection is located in the real-time duration of not more than 5 minutes, the gray scale compensation values of the TFTs obtained from the preset collection of the gray scale compensation values are respectively 2, 3, and 4. If the first duration of electricity connection is 17 minutes, there is no corresponding real-time duration detected in the preset duration table, then the real-time duration of not more than 15 minutes is adopted, and the corresponding gray scale compensation values are 8, 9, and 10.

In this embodiment, after users normally connect the AMOLED display panel to electricity and use the AMOLED display panel, it dynamically obtains different first durations of electricity connection of each TFT, confirms a time duration in a preset duration table corresponding to the dynamic first duration of electricity connection, and then from the preset collection of gray scale compensation values, it dynamically extracts a gray scale compensation value corresponding to each TFT. Through different gray scale compensation values extracted corresponding to different first durations of electricity connection, it aims at temperature drifts of different extends of each TFT occurring in different durations of electricity connection, adds more pertinence to the compensation, and efficiently solves the sticking images problem caused by different duration of electricity connection.

Furthermore, Step S30 includes:

Step S31, obtaining the display data of each TFT;

Step S32, confirming a present display gray scale based on the display data;

Step S33, summing up the display data and the gray scale compensation value corresponding to the present display gray scale, obtaining compensated display data of each TFT;

Step S34, transforming a format of the compensated display data of each TFT, obtaining compensated driving data of each TFT;

Step S35, driving each TFT to generate driving electricity based on each compensated driving data.

Firstly, it obtains the display data of each TFT on the display panel, then compares the obtained display data with preset display data, for each preset display data, there is a corresponding display gray scale; when confirming that an obtained display data is matching with a certain preset display data, the display gray scale of the present display data can be confirmed. For better interpretation, referring to the example in Step S22, after confirming the present display gray scale, each corresponding gray scale compensation value of each TFT can be obtained. Summing up the display data and the corresponding gray compensation value obtains the compensated display data of each TFT. Finally it transforms the format of the compensated display data of each TFT, obtaining each compensated driving data, each compensated driving data drives each TFT correspondingly to generate driving electricity, causing each pixel on the AMOLED display panel to emit.

In this embodiment, through obtaining a duration of different first duration of electricity connection of each TFT in the preset duration table, then dynamically extracting the gray scale compensation value corresponding to each TFT in the preset gray scale compensation value collection, then based on a display data of each TFT, confirming a present display gray scale of each TFT, and according to the present display gray scale, further confirming the gray scale compensation value of each TFT, and finally, summing up the each gray scale compensation value and the corresponding display data to obtain the compensated display data of each TFT, then transforming the format of the compensated display data of each TFT into the compensated driving data, the compensated driving data drives each TFT to generate driving electricity. Through different first durations of electricity connection and different gray scales. it confirms different gray scale compensation values. Aiming at different TFTs, there are temperature drifts of different extends produced in different durations of electricity connection and under different gray scales. it obtains different compensation values to compensate, making the driving electricity of each TFT more stable and consistent, thereby to better solve the problem of AMOLED displaying sticking images.

In a third embodiment of the AMOLED display sticking image elimination method of the present disclosure, based on the embodiment in FIG. 2, before Step S20, the method also includes:

Step S40, detecting that the display panel is connected to electricity for testing, obtaining first driving electricity values of each TFT of the display panel under different preset gray scales;

when detecting the display panel is connected to electricity for testing, preset reference luminance values of each TFT under different preset gray scales and actual luminance values of each TFT under the different preset gray scales are obtained. Then first driving data of each TFT under the different preset gray scales are amended, until that the actual luminance value and the preset luminance value of each TFT equal to each other under the different preset gray scales. The actual driving electricity values of each TFT under the different preset gray scales when the actual luminance value equals to the preset luminance value are as first driving electricity values of each TFT under the different preset gray scales.

In particular, the display panel to be connected to electricity for testing here is different from the display panel to be connected to electricity in Step S10. The display panel to be connected to electricity for testing here is referring to that when the AMOLED display panel is not yet configured with the display sticking image elimination function, executing a electricity connection, testing and calculation on the display panel in order to calculate each gray scale compensation values. There are multiple pixels on the AMOLED display panel, there is a TFT on each pixel. Through a controlling signal applied on the TFT, the on-off of the driving electricity of the TFT can be controlled, thereby controlling the emitting of the pixels. An actual driving electricity value is referring that an actual amounts of electricity going through a corresponding TFT after connected to the electricity, and can be obtained through testing. Under different gray scales, the corresponding actual driving electricity values of a same TFT are different, while under a same gray scale, different TFTs because of their individual diversification, the corresponding actual driving electricity values of the TFTs may be different. Therefore, when under different gray scales, the corresponding actual luminance values of a same TFT are different, when under a same gray scale, different TFTs because of their individual diversification, the corresponding actual luminance values of the TFTs may be different. For example, for an AMOLED display panel with high, medium, and low three gray scales, M times N amounts of pixels, there are M times N amounts of preset reference luminance values under one gray scale, and there are M times N times 3 amounts of preset reference luminance values under the three gray scales. Correspondingly, under one gray scale it can obtain M times N amounts of actual luminance values, and thus it can gets M times N times 3 amounts of actual luminance values, thereby getting M times N times 3 amounts of first driving electricity values.

Step S50, according to the first driving electricity value, obtaining and storing each gray scale compensation value of each TFT under the different preset gray scales.

It obtains the present second driving electricity values of each TFT under the different preset gray scales, as well as corresponding second driving data. Then it amends the second driving data of each TFT, such that the first driving electricity value and the second electricity value are equal under each of the preset gray scales, thus to obtain amended driving data. Finally the amended driving data minus the corresponding second driving data to obtain and store gray scale compensation values of each TFT under the different preset gray scales.

For better interpretation, here uses an example to describe, for instance, an AMOLED display panel with high, medium, low three gray scales and M times N amounts of pixels, for each gray scale, there are M times N amounts of first driving electricity, for 3 gray scales, there are M times N times 3 amounts of first driving electricity values. Correspondingly, there can be M times N amounts of second driving electricity values obtained in one gray scale, there can be M times N times 3 amounts of second driving electricity values in 3 gray scales. Correspondingly, there are M times N amounts of second driving data in one gray scale, there are M times N times 3 second driving data in 3 gray scales, thereby, through amendment, M times N times 3 amounts of gray scale compensation values can be obtained.

In this embodiment, before an AMOLED product is provided to user for normal usage, it firstly presets multiple gray scales, which is multiple different preset luminance. Then through testing, it detects when connected to electricity, the first driving electricity values of each TFT under different gray scales. It further confirms the gray scale compensation values of each TFT under the different gray scales based on the first driving electricity values. The TFTs under the same gray scale, for the individual differences, the first driving electricity values going through the TFTs may have differences. Under the different gray scales, the first driving electricity values of the same TFT are different from each other. Through detecting the first driving electricity values of each TFT under the different gray scales, and further confirming the gray scale compensation values of each TFT under the different gray scales, it obtains the gray scale compensation values that are closer to the reality. In order to avoid the differences within each TFT, uniformly adopting the driving electricity values of one single TFT to confirm each gray scale compensation value, there are individual errors.

Figure 4:
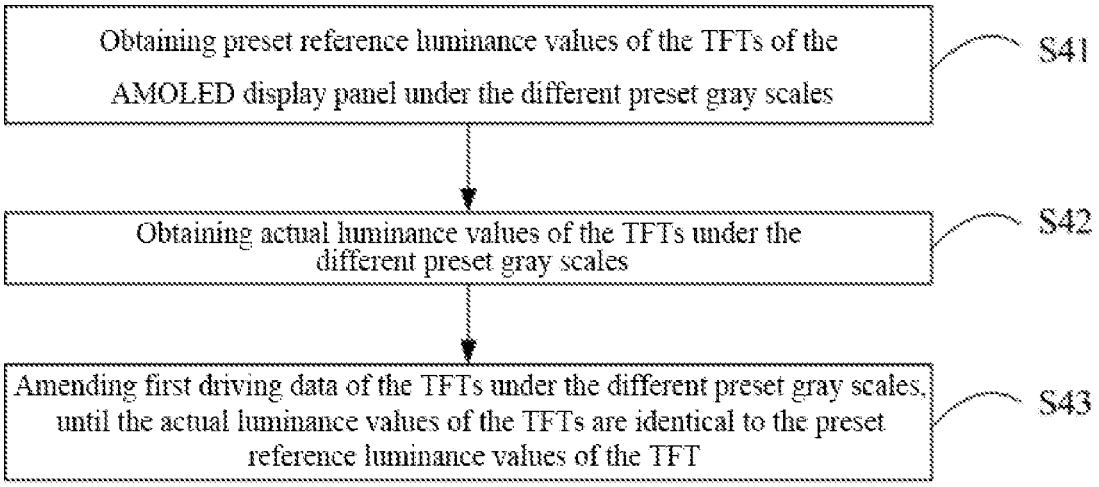
FIG. 4 is a detailed schematic flowchart of Step S40 of a second embodiment of the AMOLED display panel sticking image elimination method.

Furthermore, according to FIG. 4, Step S40 includes:

Step S41, obtaining preset reference luminance values of each TFT of the display panel under the different preset gray scales.

It firstly produces each standard gray scale signal, then obtaining each gray scale in order based on each standard gray scale signal, and each preset reference luminance value corresponding to each gray scale. Each gray scale is corresponding to one preset reference luminance value. The preset reference luminance values of the TFTs under the same gray scale are the same.

Step S42, obtaining actual luminance values of each TFT under the different preset gray scales;

It obtains the actual luminance values of each TFT on the pixels of the AMOLED display panel, the gray scale is corresponding to one actual luminance value. In theory, the actual luminance values of the TFT of the same gray scale are the same.

Figure 5:
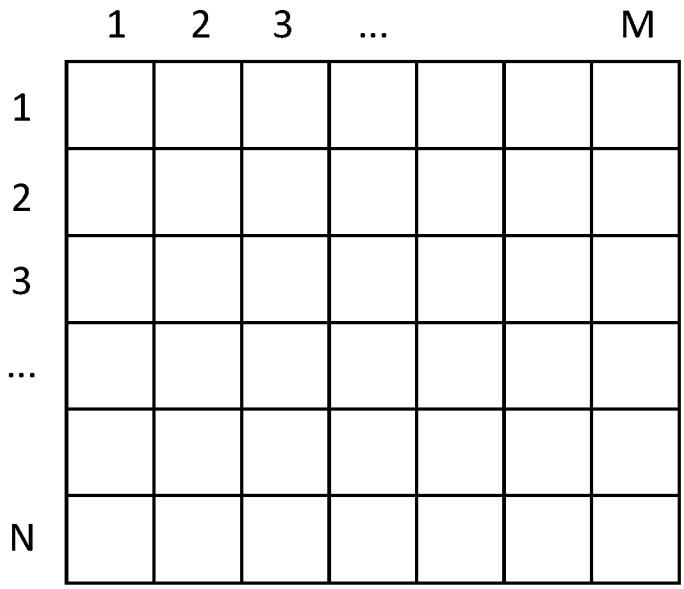
FIG. 5 is a schematic diagram of an AMOLED display panel with M times N pixels according to an embodiment of the present disclosure.

Step S43, amending, until the actual luminance values and the preset reference luminance values of each TFT are the same;

Like shown in FIG. 5, there are M times N amounts of pixels on an AMOLED display panel, and each pixel corresponds a TFT. Firstly, according to a standard gray scale signal, the gray scale is decoded into display data with M times N amounts of pixels, then the format of M times N amounts of display data is transformed into M times N amounts of driving data; then the preset reference luminance values and the corresponding actual luminance values of each TFT are compared to determine a value relationship therebetween, values of the driving data are amended, to make the actual luminance values of each TFT equal to the corresponding preset reference luminance values. In the same way, if there are multiple different gray scales, for instance, with high, medium, low three gray scales, it is able to amend according to the previous method, causing that the actual luminance values of each TFT equal to the corresponding preset reference luminance values.

Step S44, obtaining the actual driving electricity values of each TFT under the different preset gray scales when the actual luminance values are the same with the corresponding preset reference luminance values, as the first driving electricity values.

After the actual luminance values of each TFT equals to the corresponding preset reference luminance values, obtaining the actual driving electricity values of each TFT of this moment, adopting the obtained actual driving electricity values of each TFT as the first driving electricity values of the corresponding pixels, that is, the obtained actual driving electricity values of each TFT is the first driving electricity values of each TFT. For better interpretation, referring to FIG. 5, there are M times N amounts of pixels in an AMOLED display panel, thus there are M times N amounts of the first driving electricity values. In the same way, if there are multiple different gray scales, for instance, with the high, medium, and low three gray scales, respectively obtaining the first driving electricity values of each TFT under the different gray scales according to the previous method.

In this embodiment, firstly, it presets, multiple different preset reference luminance values, as the reference luminance values under the different preset gray scales, corresponding to the TFTs under the same gray scale, the preset reference luminances are the same, then it obtains actual luminance values of each TFT under the different preset gray scales as just connected to electricity for testing. Moreover, it amends first driving data of each TFT under the different preset gray scales, thereby that actual luminance values of each TFT are the same with the preset reference luminance values, and obtains the actual driving electricity values of each TFT when the actual luminance values equal to the corresponding preset reference luminance values as the first driving electricity values.

It confirms the first driving electricity values of each TFT through respectively detecting the actual luminance values of each TFT, avoiding that with individual differences of the TFTs, the first driving electricity values do not totally match with each TFT when the first electricity values is confirmed by obtaining the actual luminance of only one TFT.

Figure 7:
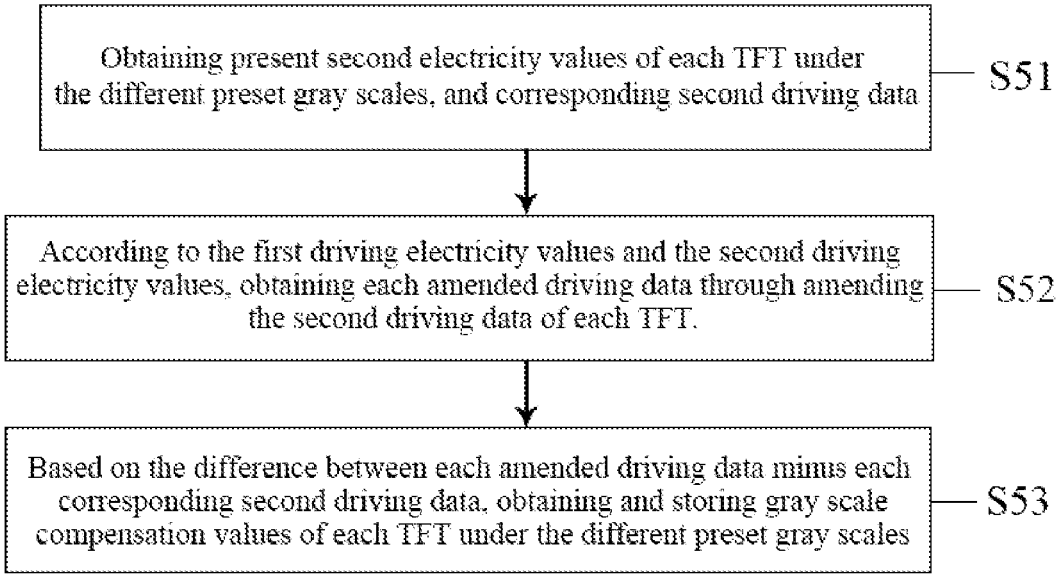
FIG. 7 is a detailed schematic flowchart of Step S50 of a third embodiment of the AMOLED display panel sticking image elimination method.

Furthermore, according to FIG. 7, Step S50 includes:

Step S51, obtaining present second electricity values of each TFT under the different preset gray scales, and corresponding second driving data;

it obtains a second duration of electricity connection of a display panel as connected to electricity for testing. Respectively at timing points of different second durations of electricity connection, it obtains the second driving electricity values of each TFT under the different preset gray scales, as well as the corresponding second driving data, until the second duration of electricity connection reaches a threshold duration.

For better interpretation, describing by examples, for instance, it obtains 3 timing points within a duration of not more than 15 minutes, the second duration of electricity connection at the timing points of 5 minutes, not less than 6 minutes and not more than 10 minutes, and not less than 11 minutes and not more than 15 minutes. Respectively obtaining the second driving electricity values of each TFT under the high, medium, low three different gray scales at each timing point, as well as the driving data respectively corresponding to the second driving electricity values of each TFT.

Step S52, according to the first driving electricity values and the second driving electricity values, obtaining each amended driving data through amending the second driving data of each TFT.

It compares the obtained second driving electricity values with the first driving electricity values, and amends each driving data based on the comparison results of the first driving electricity values and the second driving electricity values. When the first driving electricity values do not equal to the second driving electricity values, it amends each driving data, until all of the first driving electricity values equal to the corresponding second driving electricity values. It obtains each actual driving data when each first driving electricity values equal to the corresponding second driving electricity value, as the corresponding amended driving data of each TFT.

Step S53, based on the difference between each amended driving data minus each corresponding second driving data, obtaining and storing gray scale compensation values of each TFT under the different preset gray scales.

It adopts the difference between each amended driving data minus each corresponding second driving data as each gray scale compensation value of each TFT. In the same way, it is able to obtain the gray scale compensation values of each TFT under the different gray scales, and the gray scale compensation values of each TFT under different gray scales and different second durations of electricity connection, storing all of the obtained gray scale compensation values.

In this embodiment, it confirms the first driving electricity values of each TFT under the different gray scales as standard reference electricity values through presetting reference luminance values, and then it obtains the second driving electricity values of each TFT of different second durations of electricity connection under each gray scale, compares the second driving electricity values to the corresponding first driving electricity values, and amends the driving data to adjust the second driving electricity values, thereby the second driving electricity values equal to the corresponding first driving electricity values, and achieving the effect that driving electricity going through each TFT is consistent, display luminance is consistent, and eliminating display sticking images.

Figure 6:
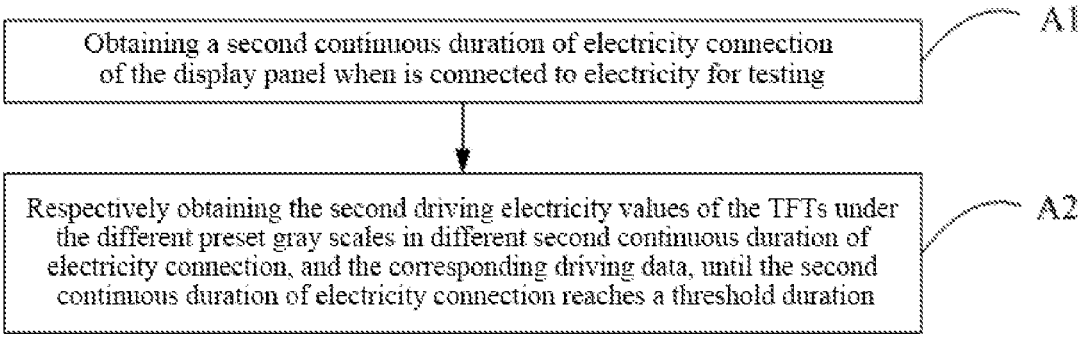
FIG. 6 is a detailed schematic flowchart of Step S51 of a third embodiment of the AMOLED display sticking image elimination method of the present disclosure.

Referring to FIG. 6, in the forth embodiment of the AMOLED display sticking image elimination method of the present disclosure, based on the embodiment in FIG. 5, Step S51 includes:

Step A1, obtaining the second durations of electricity connection of the display panel when connected to electricity for testing.

Step A2, respectively in different second durations of electricity connection, obtaining the second driving electricity values of each TFT under the different preset gray scales and the corresponding driving data, until the second duration of electricity connection reaches a threshold duration.

Firstly, it sets a threshold duration, and obtains the second duration of electricity connection of the display panel when connected to electricity for testing as a judging timing point. It obtains the second driving electricity values of each TFT respectively at the judging timing points of different second durations of electricity connection, and the corresponding driving data of each TFT, until the second duration of electricity connection reaches the threshold duration. In the same way, obtaining the second driving electricity values of each TFT under the different preset gray scales, and the corresponding driving data of each TFT.

For better interpretation, describing by examples, for instance, it firstly sets a threshold duration, for example 15 minutes, then sets 3 timing points being the fifth minute, tenth minute and fifteenth minute in the 15 minutes, respectively as the judging timing points of the second duration of electricity connection. It obtains respectively the second driving electricity values of each TFT at the 3 timing points of the second duration of electricity connection, as well as the corresponding driving data of each TFT, until the obtained second duration of electricity connection reaches the timing point of the fifteenth minute. In the same way, it obtains the second driving electricity values of each TFT at each timing point of each second duration of electricity connection under the different preset gray scales, and the corresponding driving data of each TFT. More specifically, for an AMOLED display panel set with high, and low two gray scales and M times N amounts of pixels, there are M times N amounts of first driving electricity values in one gray scale, and there are M times N times 2 amounts of driving electricity values under two gray scales. Correspondingly, there are M times N amounts of second driving electricity values obtained in one gray scale, and there are M times N times 2 amounts of second driving electricity values totally obtained in two gray scales. Correspondingly, there are M times N amounts of driving data in one gray scale, and there are M times N times 2 amounts of driving data on two gray scales. For an AMOLED display panel set with high, and low two gray scales and M times N amounts of pixels, at three judging timing points, there are totally M times N times 2 amounts of first driving electricity values, M times N times 2 times 3 amounts of second driving electricity value, M times N times 2 times 3 amounts of driving data.

In this embodiment, through obtaining different second durations of electricity connection when a display panel is connected to electricity for testing, as well as obtaining the second driving electricity values of each TFT of different second durations of electricity connection and driving data of each TFT, in order to further obtain gray scale compensation values of each TFT under different duration, it avoids that different temperature drifts are produced in different durations of electricity connection, and the temperature drift of the TFT after a certain time duration can not be compensated precisely when there is only one single gray scale compensation value. It allows to compensate through different gray scale compensation values in different durations of electricity connection when normally used by a user, thereby in a relatively long period of time, the display sticking images problem is eliminated properly.

Figure 8:
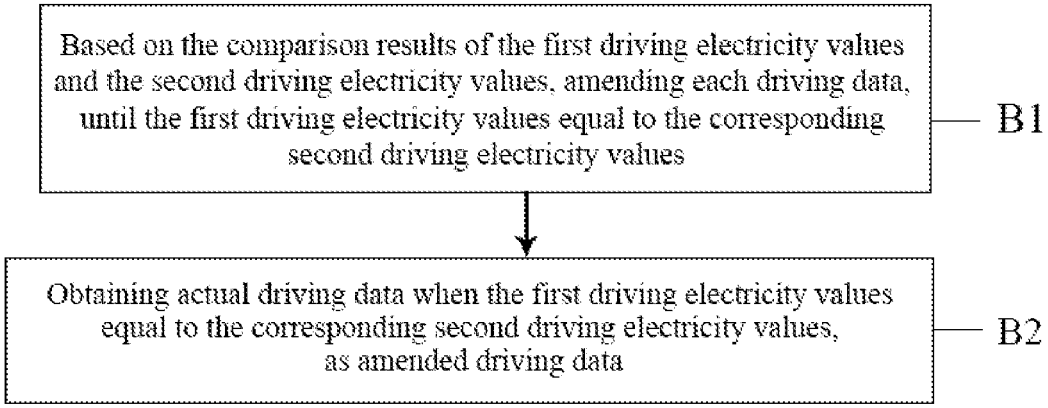
FIG. 8 is a detailed schematic flowchart of Step S52 of a third embodiment of the AMOLED display sticking image elimination method of the present disclosure.

Furthermore, according to FIG. 8, Step S52 includes:

Step B1, based on the comparison results of the first driving electricity values and the second driving electricity values, amending each driving data, until the first driving electricity values equal to the corresponding second driving electricity values.

Step B2, obtaining actual driving data when the first driving electricity values equal to the corresponding second driving electricity values, as amended driving data.

Based on the comparison results of the first driving electricity values and the corresponding the second driving electricity values, the values of corresponding driving data are amended. When a first driving electricity value is larger than a corresponding second driving electricity value, the value of the driving data is reduced, when the first driving electricity value is less than the corresponding second driving electricity value, the value of the driving data is increased, when the first driving electricity value equals to the corresponding second driving electricity value, the driving data is kept consistent, until all of the first actual driving electricity values equal to the corresponding second driving electricity values. It obtains actual driving data of each TFT when the first actual driving electricity values equals to the corresponding each second driving electricity values, and defines each actual driving data of each TFT obtained as each amended driving data.

For better interpretation, describing by examples, for instance, for an AMOLED display panel set with high, medium, and low three gray scales, and M times N amounts of pixels, there are M times N amounts of first driving electricity values in one gray scale, and there are M times N times 3 amounts of first driving electricity values in three gray scales. Correspondingly, there are M times N amounts of second driving electricity values obtained in one gray scale, and there are M times N times 3 amounts of second driving electricity values obtained in three gray scales. Correspondingly, there are M times N amounts of driving data in one gray scale, and there are M times n times 3 amounts of driving data in three gray scales. Through amending M times N times 3 amounts of driving data, it obtains M times N tomes 3 amounts of actual driving data when the first driving electricity values equal to the second driving electricity values, thus obtains M times N times 3 amounts of amended driving data.

In this embodiment, the driving data are amended under different second durations of electricity connection and different gray scales, to keep a second driving electricity and a first driving electricity to be consistent, thereby confirming different gray scale compensation values. In this case, there are corresponding gray scale compensation value for compensating in different durations of electricity connection when an AMOLED display is normally used by a user, avoiding the value differences of temperature drifts produced in different durations of electricity connection, and the temperature drifts of TFT after a certain period of time can not be precisely compensated when there is only one single gray scale compensation value, and obtaining different second duration of electricity connection and gray scale compensation values under different gray scales.

Besides, the embodiments of the present disclosure also discloses a computer readable storage medium, an AMOLED display sticking image elimination program is stored in the computer readable storage medium. When the AMOLED display sticking image elimination program is implemented by a processor, the steps of the AMOLED display sticking image elimination method mentioned above are implemented.

The detailed embodiments of the computer readable storage medium of the present disclosure refer to the embodiments of the AMOLED display sticking image elimination method, no more further detailed description is given here.

It should be noted that, herein, the terms "comprise" "include" or any other variation thereof, are intended to cover a non-exclusive inclusion, such that a process, method, article, or system that includes a series of elements not only includes those elements but also includes other elements not expressly listed, or that is an element inherent to such process, method, article, or system. In the absence of more constraints, the elements described by the term "including one . . . " do not preclude the presence of additional identical elements in the process, method, article, or system.

The embodiments of the present disclosure are described merely for the purpose of description and do not represent the disadvantages of the embodiments.

Through the description of the embodiments above, it will be clear to those skilled in the art that the above-described embodiments can be realized by means of adopting a software-plus-necessary-general-hardware platform, although, of course, the former can be implemented in hardware, but in many cases the former is a better embodiment. Based on such an understanding, the technical solutions of the present disclosure may be embodied in the form of a software product that is stored in a storage medium (e.g., a ROM RAM, a magnetic disk, an optical disk) as described above, including a number of instructions for causing a display terminal device (which may be a television, a cell phone, a computer, a server, an air conditioner, or a network device, etc.) to perform the method of various embodiments of the present disclosure The above are merely preferred embodiments of the present disclosure, and is not intended to limit the scope of the present disclosure. Any equivalent structure or equivalent process transformation based on the description and the drawings of the present disclosure or applying directly or indirectly to other related technical fields, and are all included in the patent protection scope of the present disclosure.

What is claimed is:

1. An AMOLED (Active-matrix Organic Light-Emitting Diode) display sticking image elimination method, comprising: calculating a first duration of electricity connection of an AMOLED display panel upon detecting the AMOLED display panel is connected to electricity; obtaining a first driving electricity value of each TFT (thin film transistor) of the AMOLED display panel under different preset gray scales upon detecting that the AMOLED display panel is connected to electricity for testing; obtaining and storing a gray scale compensation value of each TFT under the different preset gray scales based on the first driving electricity value; obtaining the gray scale compensation value of each TFT based on the first duration of electricity connection; and amending a driving electricity of each TFT of the AMOLED display panel based on the gray scale compensation value.

2. The AMOLED display sticking image elimination method according to claim 1, wherein, the step of obtaining the gray scale compensation value of each TFT based on the first duration of electricity connection comprises:

dynamically obtaining a real-time duration that the first duration of electricity connection falls in according to a preset duration table; and dynamically extracting the gray scale compensation value of each TFT from a preset gray scale compensation value set based on the real-time duration.

3. The AMOLED display sticking image elimination method according to claim 1, wherein, the step of amending a driving electricity of each TFT of the AMOLED display panel based on the gray scale compensation value comprises:

obtaining display data of each TFT;

confirming a preset display gray scale based on the display data;

adding the display data of each TFT and the gray scale compensation value corresponding to the preset display gray scale, and obtaining compensated display data;

transforming a format of the compensated display data, and obtaining compensated driving data; and driving each TFT to generate a driving electricity based on the compensated driving data.

4. The AMOLED display sticking image elimination method according to claim 1, wherein, the step of obtaining a first driving electricity value of each TFT of the AMOLED display panel under different preset gray scales upon detecting that the display panel is connected to electricity for testing comprises:

obtaining a preset reference luminance value of each TFT of the AMOLED display panel under the different preset gray scales;

obtaining an actual luminance value of each TFT under the different preset gray scales;

amending a first driving data of each TFT under the different preset gray scales, until the actual luminance value of each TFT is identical to the preset reference luminance value each TFT; and obtaining an actual driving electricity value of each TFT under the different preset gray scales when the actual luminance value is identical to the preset reference luminance value, as the first driving electricity value of each TFT.

5. The AMOLED display sticking image elimination method according to claim 1, wherein, the step of obtaining and storing a gray scale compensation value of each TFT under the different preset gray scales based on the first driving electricity value comprises:

obtaining a preset second driving electricity value of each TFT under the different preset gray scales, and a second driving data corresponding to the preset second driving electricity value;

amending the second driving data of each TFT to obtain amended driving data based on the first driving electricity value and the second driving electricity value; and obtaining and storing the gray scale compensation value of each TFT under the different preset gray scales based on a difference of the amended driving data minus the second driving data.

6. The AMOLED display sticking image elimination method according claim 5, wherein, the step of obtaining a preset second driving electricity value of each TFT under the different preset gray scales, and a second driving data corresponding to the preset second driving electricity value comprises:

obtaining a second duration of electricity connection of the display panel when the display panel is connected to electricity for testing; and respectively obtaining the second driving electricity value of each TFT under the different preset gray scales in different second duration of electricity connection, and the driving data corresponding to the second driving electricity value, until the second duration of electricity connection reaches a threshold duration.

7. The AMOLED display sticking image elimination method according to claim 5, wherein, the step of amending the second driving data of each TFT to obtain amended driving data based on the first driving electricity value and the second electricity value comprises:

amending values of the second driving data, based on a value relationship of the first driving electricity value and the second driving electricity value, until the first driving electricity value is identical to the second driving electricity value; and obtaining actual driving data of each TFT when the first driving electricity value is identical to the second driving electricity value, as the amended driving data.

8. An display terminal, comprising an AMOLED (Active-matrix Organic Light-Emitting Diode) display panel, a storage, a processor, and an AMOLED display sticking image elimination program stored in the storage and configured to be performed on the processor, the steps below are realized when the AMOLED display sticking image elimination program are performed by the processor: calculating a first duration of electricity connection of the AMOLED display panel upon detecting the AMOLED display panel is connected to electricity; obtaining a first driving electricity value of each TFT (thin film transistor) of the AMOLED display panel under different preset gray scales upon detecting that the AMOLED display panel is connected to electricity for testing; obtaining and storing a gray scale compensation value of each TFT under the different preset gray scales based on the first driving electricity value; obtaining the gray scale compensation value of each TFT based on the first duration of electricity connection; and amending a driving electricity of each TFT of the AMOLED display panel based on the gray scale compensation value.

9. The display terminal according to claim 8, wherein, the step of obtaining the gray scale compensation value of each TFT based on the first duration of electricity connection comprises:

dynamically obtaining a real-time duration that the first duration of electricity connection falls in according to a preset duration table; and dynamically extracting the gray scale compensation value of each TFT from a preset gray scale compensation value set based on the real-time duration.

10. The display terminal according to claim 8, wherein, the step of amending a driving electricity of each TFT of the AMOLED display panel based on the gray scale compensation value comprises:

obtaining display data of each TFT;

confirming a preset display gray scale based on each display data;

adding the display data of each TFT and the gray scale compensation value of the preset display gray scale, and obtaining compensated display data;

transforming a format of the compensated display data, and obtaining compensated driving data; and driving each TFT to generate a driving electricity based on the compensated driving data.

11. The display terminal according to claim 8, wherein, the step of obtaining a first driving electricity value of each TFT of the AMOLED display panel under different preset gray scales upon detecting that the display panel is connected to electricity for testing comprises:

obtaining a preset reference luminance value of each TFT of the AMOLED display panel under the different preset gray scales;

obtaining an actual luminance value of each TFT under the different preset gray scales;

amending a first driving data of each TFT under the different preset gray scales, until the actual luminance value of each TFT is identical to the preset reference luminance value of each TFT; and obtaining an actual driving electricity value of each TFT under the different preset gray scales when the actual luminance value is identical to the preset reference luminance value, as the first driving electricity values of each TFT.

12. The display terminal according to claim 8, wherein, the step of obtaining and storing a gray scale compensation value of each TFT under the different preset gray scales based on the first driving electricity value comprises:

obtaining a preset second driving electricity value of each TFT under the different preset gray scales, and a second driving data corresponding to the preset second driving electricity value;

amending the second driving data of each TFT to obtain amended driving data based on the first driving electricity value and the second driving electricity value; and obtaining and storing gray scale compensation value of each TFT under the different preset gray scales based on a difference of each of the amended driving data minus the second driving data.

13. The display terminal according to claim 12, wherein, the step of obtaining a preset second driving electricity value of each TFT under the different preset gray scales and a second driving data corresponding to the preset second driving electricity value comprises:

obtaining a second duration of electricity connection when the display panel is connected to electricity for testing; and respectively obtaining second driving electricity value of each TFT under the different preset gray scales in different second duration of electricity connection, and the driving data corresponding to the second driving electricity value, until the second duration of electricity connection reaches a threshold duration.

14. The display terminal according to claim 12, wherein, the step of amending the second driving data of each TFT to obtain amended driving data based on the first driving electricity value and the second driving electricity value comprises:

amending values of the second driving data, based on a value relationship of the first driving electricity value and the second driving electricity value, until the first driving electricity value is identical to the second driving electricity value; and obtaining actual driving data of each TFT when the first driving electricity value is identical to the second driving electricity value, as the amended driving data.

15. A computer readable storage medium, wherein, an AMOLED (Active-matrix Organic Light-Emitting Diode) display sticking image elimination program is stored in the computer readable storage medium, when the AMOLED display sticking image elimination program is performed by a processor, the following steps are realized: calculating a first duration of electricity connection of an AMOLED display panel upon detecting the AMOLED display panel is connected to electricity; obtaining a first driving electricity value of each TFT (thin film transistor) of the AMOLED display panel under different preset gray scales upon detecting that the AMOLED display panel is connected to electricity for testing; obtaining and storing a gray scale compensation value of each TFT under the different preset gray scales based on the first driving electricity value; obtaining the gray scale compensation value of each TFT based on the first duration of electricity connection; and amending a driving electricity of each TFT of the AMOLED display panel based on the gray scale compensation value.

16. The computer readable storage medium according to claim 15, wherein, the step of obtaining the gray scale compensation value of each TFT based on the first duration of electricity connection comprises:

dynamically obtaining a real-time duration that the first duration of electricity connection falls in according to a preset duration table; and dynamically extracting the gray scale compensation value of each TFT from a preset gray scale compensation value set based on the real-time duration.

17. The computer readable storage medium according to claim 15, wherein, the step of amending a driving electricity of each TFT of the AMOLED display panel based on the gray scale compensation value comprises:

obtaining display data of each TFT;

confirming a preset display gray scale based on the display data;

adding the display data of each TFT and the gray scale compensation value corresponding to the present display gray scale, and obtaining compensated display data;

transforming a format of the compensated display data, and obtaining compensated driving data; and driving each TFT to generate a driving electricity based on the compensated driving data.

* * * * *